US006681730B1

(12) United States Patent
Koneda et al.

(10) Patent No.: US 6,681,730 B1
(45) Date of Patent: Jan. 27, 2004

(54) HYDRAULIC DAMPER FOR AN ELECTROMECHANICAL VALVE

(75) Inventors: Philip Thomas Koneda, Novi, MI (US); Thomas William Megli, Dearborn, MI (US); Stephen John Agdorny, Ypsilanti, MI (US); Allan Roy Gale, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/064,897

(22) Filed: Aug. 27, 2002

(51) Int. Cl.[7] ..... F01L 9/04

(52) U.S. Cl. ..... 123/90.11; 123/90.12; 123/90.49; 92/85 B; 251/48

(58) Field of Search ..... 123/90.11, 90.12, 123/90.15, 90.16, 90.17, 90.24, 90.35, 90.55, 90.49; 251/129.01, 129.02, 129.05, 129.16, 48, 54; 92/143, 85 B

(56) References Cited

U.S. PATENT DOCUMENTS 3,853,102 A * 12/1974 Myers et al. ..... 123/90.49
3,887,019 A 6/1975 Reynolds et al.
4,883,025 A 11/1989 Richeson, Jr.
5,275,136 A * 1/1994 Schechter et al. ..... 123/90.12
5,832,883 A 11/1998 Bae
6,024,060 A * 2/2000 Buehrle, II et al. ..... 123/90.11
6,076,490 A 6/2000 Esch et al.
6,101,992 A * 8/2000 Pischinger et al. ..... 123/90.11
6,116,570 A 9/2000 Ulgatz et al.
6,192,841 B1 * 2/2001 Vorih et al. ..... 123/90.12
6,205,964 B1 * 3/2001 Maisch et al. ..... 123/90.11
6,237,550 B1 * 5/2001 Hatano et al. ..... 123/90.11

FOREIGN PATENT DOCUMENTS

FR 2650362 A1 * 2/1991 ..... F16K/31/02

* cited by examiner

*Primary Examiner*—Thomas Denion
*Assistant Examiner*—Ching Chang

(57) ABSTRACT

A hydraulic system for an electromechanical valve is provided. The system includes a housing defining a chamber for holding fluid extending along an axis. The system further includes a damper stem disposed in the chamber configured to move along the axis. The damper stem is configured to be directly coupled to the valve member. The system further includes a piston coupled to the damper stem dividing the chamber into a first chamber portion and a second chamber portion. The housing includes a conduit extending between the first chamber portion and the second chamber portion. The conduit has a first non-cylindrical opening communicating with the first chamber portion. When the piston moves past at least a portion of the non-cylinder opening, the cross-sectional area of the opening decreases to restrict fluid flow from the first chamber to reduce a velocity of the piston.

9 Claims, 3 Drawing Sheets

HYDRAULIC DAMPER FOR AN ELECTROMECHANICAL VALVE

BACKGROUND OF INVENTION

1. Field of the Invention

The invention relates to a hydraulic damper for an electromechanical valve, and in particular, to a hydraulic damper that can provide relatively soft seating of an engine valve on an engine valve seat.

2. Background Art

Internal combustion engines have been designed that utilize electromechanically actuated intake and exhaust valves. Known electromechanical valves use first and second solenoids to induce an inner armature to move in first and second axial directions, respectively. The armature may be coupled to a valve member that opens and closes a respective port to an engine cylinder. A problem associated with known electromechanical valves is that it is extremely difficult to control the landing speed (i.e., the seating speed) of a valve head against a valve seat. If the landing speed is too high, the engine valve seat can become degraded.

In an attempt to solve this problem, a known system in U.S. Pat. No. 5,832,883 utilized a hydraulic damper for reducing the seating speed in an electromechanical valve assembly. In this damper system, a piston is disposed in a chamber filled with oil. The piston is connected to a valve member and separates the chamber into an upper portion and a lower portion. The piston also contains a constant area orifice extending therethrough. The first and second chamber portions are also connected by a conduit. As the piston moves in a first direction, fluid is pushed through the conduit (and the constant area orifice) from the first chamber portion to the second chamber portion. When the piston moves proximate an end position and closes off an opening to the conduit, the constant area orifice continues to allow fluid to pass from the first chamber portion to the second chamber portion. The fluid flow through the constant area orifice, however, prevents the damping pressure in the first chamber from reaching a relatively high pressure. Further, the reduced damping pressure in the first chamber portion can result in the valve member—connected to the damper piston—having a relatively high seating speed when it contacts the valve seat. As discussed above, the relatively high landing speed may undesirably degrade the valve seat and valve member.

Another known hydraulic damper is described in U.S. Pat. No. 6,205,964. The hydraulic damper includes a damping piston that only contacts a valve member near a valve seating position. However, a problem with this damper is that intermittently contacting of the valve member against a damper piston can generate undesirable noise.

Thus, the inventors herein have recognized that a hydraulic damper for electromechanical valve assemblies is needed that can reduce and/or eliminate one or more of the above-mentioned deficiencies.

SUMMARY OF INVENTION

A hydraulic system in accordance with the present invention provides relatively soft seating for a valve member on an engine valve seat.

The hydraulic system for an electromechanical valve includes a housing defining a chamber for holding fluid extending along an axis. The system further includes a damper stem disposed in the chamber configured to move along the axis. The damper stem is configured to be directly coupled to a valve member. The system further includes a piston coupled to the damper stem dividing the chamber into a first chamber portion and a second chamber portion. The housing includes a conduit extending between the first chamber portion and the second chamber portion. The conduit has a first non-cylindrical opening communicating with the first chamber portion. When the piston moves past at least a portion of the non-cylinder opening, the cross-sectional area of the opening decreases to restrict fluid flow from the first chamber to reduce a velocity of the piston. The area of this opening continues to decrease as the valve approaches its seat.

The hydraulic system in accordance with the present invention provides a substantial advantage over known systems. In particular, the hydraulic system utilizes a conduit having a non-cylindrical opening to control a damping force prior to and during valve seating to dramatically reduce a seating velocity.

Another advantage of the present system is that the damper stem of the damper can be directly coupled to an engine valve member to remove any undesirable contact noise between a valve member and a component of the damper.

DETAILED DESCRIPTION

Figure 1:
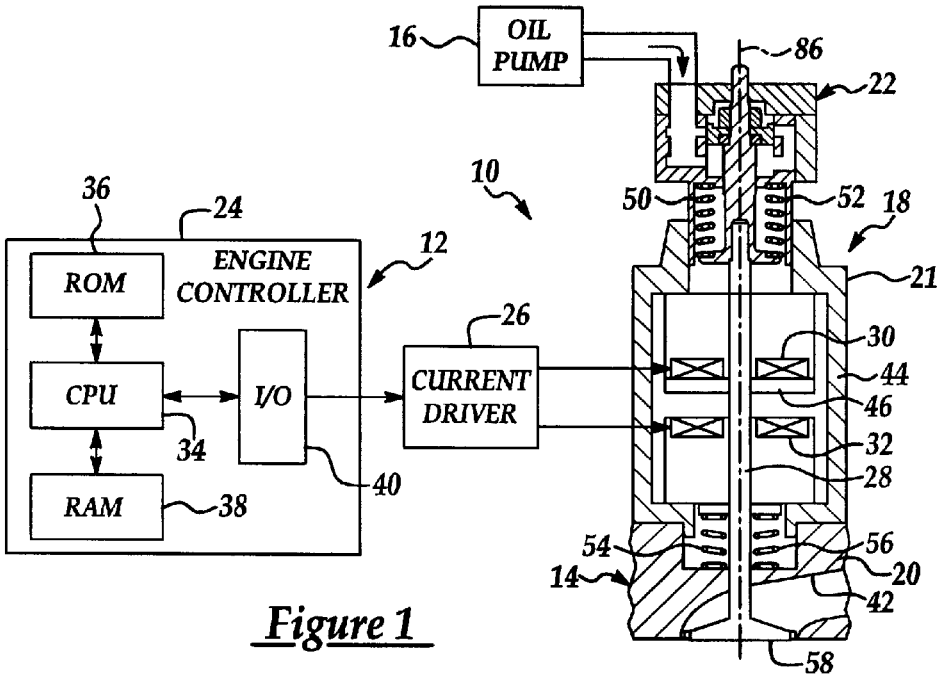
FIG. 1 is a schematic of vehicle engine having an electromechanical valve assembly with a hydraulic damper in accordance with the present invention.

Referring now to the drawings, like reference numerals are used to identify identical components in the various views. Referring to FIG. 1, a vehicle 10 having an engine control system 12, an engine 14, and an oil pump 16 is illustrated. The engine 14 includes an electromechanical valve assembly 18 mounted to an engine head 20. The valve assembly 18 includes an electromechanical actuator 21 and a hydraulic damper 22 in accordance with the present invention.

Engine control system 12 includes engine controller 24 and current driver 26. Controller 24 generates control signals to control an operational position of a valve member 28 of valve assembly 18. The current driver 26 receives the control signals from controller 24 and in response generates current signals to energize and de-energize coils 30, 32 of actuator 21 to control the position of valve member 28, as will be explained in greater detail below. As illustrated, controller 24 includes a central processing unit (CPU) 34, a read only memory (ROM) 36, a random access memory (RAM) 38, and input/output (I/O) ports 40.

Figure 2:
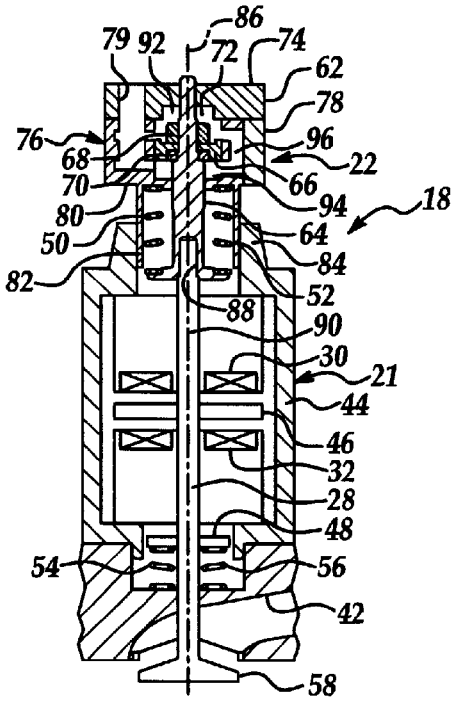
FIGS. 2 and 3 are schematics of the electromechanical valve assembly of FIG. 1 in first and second operational positions.

As discussed above, electromechanical valve assembly 18 includes electromechanical actuator 21 and damper 22. Actuator 21 is provided to control gas flow through a port 42 communicating with an engine cylinder (not shown). Actuator 21 can be disposed in an intake port or an exhaust port communicating with the engine cylinder. In particular, actuator 21 controls an axial position of valve member 28 to control gas flow through port 42. Referring to FIG. 2, actuator 21 includes actuator housing 44, valve member 28, coils 30, 32, armature plate 46 and spring retainer plate 48 attached to member 28, and springs 50, 52, 54, 56. As illustrated, housing 44 encloses the remaining of the actuator components and may be mounted to engine head 20 via conventional fasteners (not shown).

Figure 3:
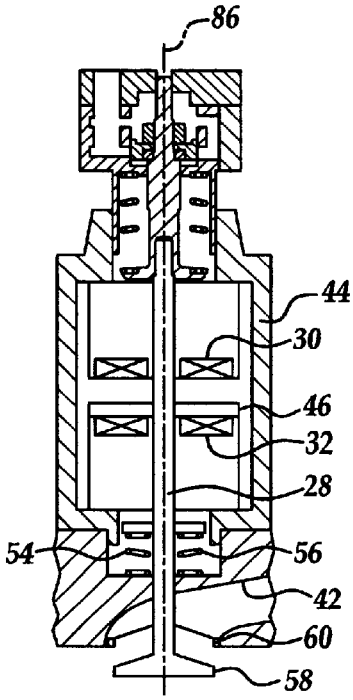

Referring to FIG. 3, when coil 32 is de-energized by controller 24, springs 54, 56 induces valve member 28 to move upwardly so that a valve head 58 approaches valve seat 60. During this movement, coil 30 is energized causing armature plate 46 to move toward coil 30—which in turn causes valve head 60 to be seated against a valve seat 60 in fully closed position. The closed position of valve member 58 is illustrated in FIG. 1. Thus, gas flow through port 42 is prevented from either entering or exiting an engine cylinder (not shown).

Referring to FIG. 1, when coil 30 is de-energized, springs 50, 52 induce valve member 28 to move downwardly so that valve head 58 moves away from valve seat 60. Referring to FIG. 3, during this movement, coil 32 is energized which causes armature plate 46 to be attracted toward coil 32 and valve head 58 to be moved to a fully open position. The fully open position is illustrated in FIG. 3. Thus, gas flow through port is allowed to enter or exit an engine cylinder through port 42.

Referring to FIG. 2, hydraulic damper 22 in accordance with the present invention is provided to allow relatively soft seating of valve head 58 on valve seat 60. Damper 22 includes a housing 62, a damper stem 64, a piston 66, a retaining nut 68, and a washer 70.

Housing 62 is provided to form a chamber 72 for holding a damping fluid such as engine oil. Chamber 72 comprises a top plate 74, a body portion 76, and a side plate 78.

Top plate 74 and side plate 78 may be attached to body portion 76 via conventional fasteners (not shown) to form chamber 72. Top plate 74 has a bore 79 extending therethrough for communicating oil from engine oil pump 16 to chamber 72. The pump 16 provides lubrication oil to several engine components, like bearings for example, and the oil that would normally be provided to an engine camshaft is now delivered to chamber 72, at the same pressure that is required by the other engine components. Lubrication pressure is typically regulated between 10 and 80 P.S.I. Body portion 76 includes a bottom plate 80 and annular attachment portion 82—axially extending from plate 80—that may be attached to a receiving portion 84 of housing 62. In particular, attachment portion 82 may have external threads (not shown) that couple to threads disposed on an internal surface of receiving portion 84 of actuator 21.

Damper stem 64 extends along an axis 86 through chamber 72 of housing 62 and is coupled to a valve stem 90 of valve member 28. In particular, damper stem 64 may have an internal threaded bore 88 that threadably receives one end of valve stem 90. Thus, valve stem 90 and damper stem 64 are coupled together and move in unison in first and second axial directions.

Piston 66 is coupled around damper stem 64 between a washer 70 and a retainer nut 68. Piston 66 is provided to divide chamber 72 into a chamber portion 92 above the piston 66 and a chamber portion 94 below the piston 66. Housing 62 also includes a conduit 96 which extends between chamber portions 92, 94.

When damper stem 64 and piston 66 move axially upwardly, the volume of chamber portion 92 decreases and the volume of chamber portion 94 increases. Further, fluid in portion 92 is moved through conduit 96 to chamber portion 94. Because the fluid must travel through conduit 96 before entering the chamber portion 94, a pressure differential occurs where the pressure in portion 94 is lower than the pressure in portion 92. This pressure differential between the portions 92, 94 produces a damping force in portion 92 opposing motion in a first axial direction (upward direction in FIG. 2). When the piston 66 begins to close off an opening 98 of conduit 96, fluid flow is further restricted from portion 92 to portion 94. This fluid restriction increases the damping force in chamber portion 92 which further reduces the velocity of piston 66, damper stem 64, and valve member 28—during valve seating—which will be described in greater detail below.

Similarly, when damper stem 64 and piston 66 move axially downwardly, the volume of chamber portion 94 decreases and the volume of chamber portion 92 increases. Further, fluid in portion 92 is moved through conduit 96 to portion 94. Because the fluid must travel through the conduit 96 before entering the chamber portion 92, a pressure differential occurs where the pressure in portion 92 is lower than the pressure in portion 94. This pressure differential between the chamber portions 92, 94 produces a damping force in portion 94 opposing motion in a second axial direction (downward direction in FIG. 2). When the piston 66 begins to close off an opening 100 of conduit 96, fluid flow is further restricted from chamber portion 92 to portion 94. This fluid restriction increases the damping force in chamber portion 94 which further reduces the velocity of piston 66, damper stem 64 and valve member 28—which will be described in greater detail below.

Figure 4:
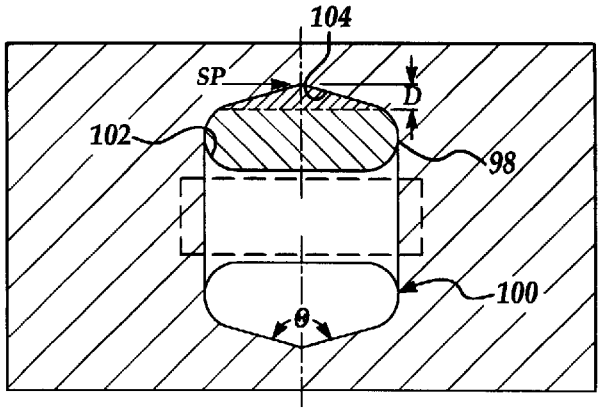
FIG. 4 is a cross-sectional schematic of a portion of a hydraulic damper in accordance with the present invention used in the electromechanical valve assembly of FIG. 2.

Referring to FIGS. 2 and 4, a detailed explanation of how the damper 22 operates prior to and during valve seating will now be discussed. As illustrated, conduit 96 includes valve openings 98, 100 communicating with chamber portions 92, 94. Because openings 98, 100 can have a similar shape and operating characteristic, only opening 98 will be discussed in detail. As shown, opening 98 includes first and second opening portions 102, 104. The second opening portion 104 tapers over a predetermined distance, such as 1 mm for example, to provide an increasing damping force in chamber 92 prior to valve seating. The portion 104 can also be configured to provide a linear or non-linear decrease in the velocity of valve member 28 as it approaches a seating position. For example, the portion 104 shown in FIG. 4 provides a substantially linear decrease in the velocity of valve member 28 as it approaches the seating position against valve seat 60. It should be noted that the taper angle ($\theta$) and axial distance (D) of second opening portion 104 can be varied based upon a desired velocity profile prior to and during valve seating.

Figure 5:
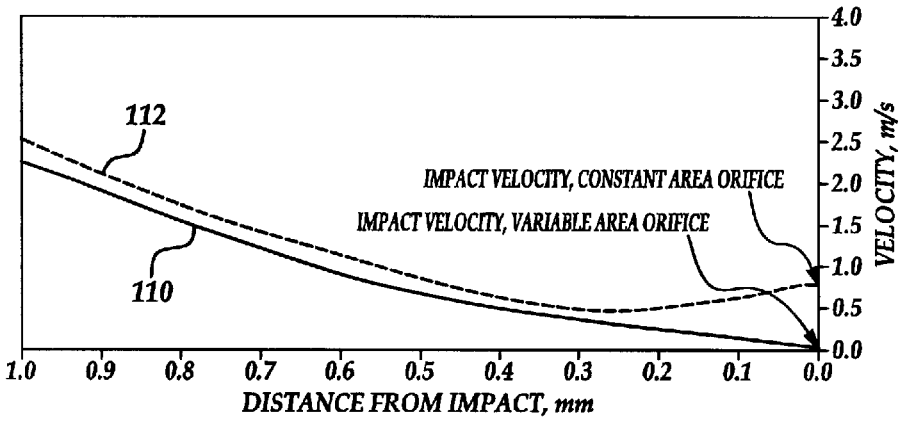
FIG. 5 illustrates velocity curves of a valve member prior to valve seating using the inventive hydraulic damper and a conventional damper.
Figure 6:
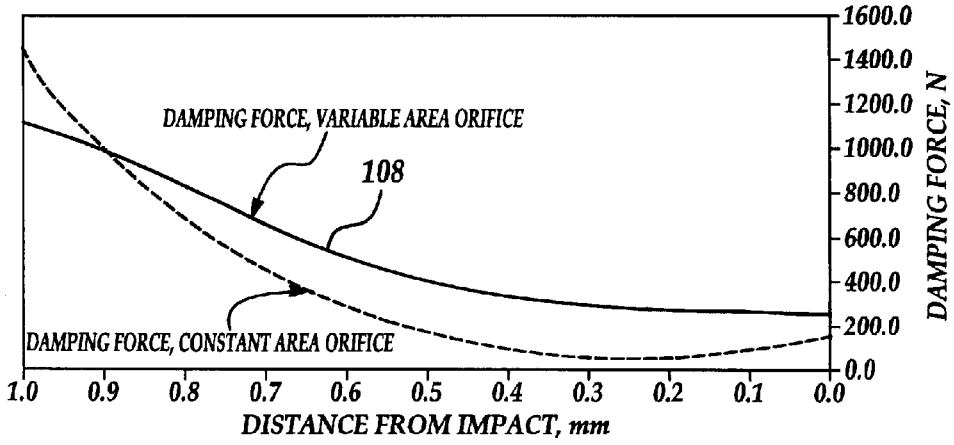
FIG. 6 illustrates damping force curves of the inventive hydraulic damper and a conventional damper prior to valve seating.
Figure 7:
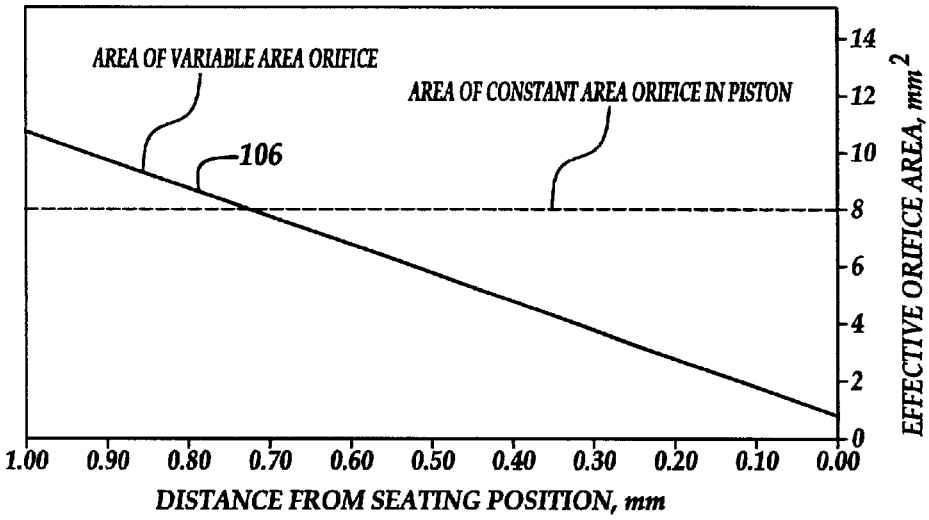
FIG. 7 illustrates effective orifice area curves of the inventive hydraulic damper and a conventional damper prior to valve seating.

Referring to FIG. 7, a graph of the effective area of the second opening portion 104 is shown during the last 1 mm of travel of piston 66, damper stem 64, and valve member 28 before valve seating occurs. In particular, curve 106 illustrates the effective cross-sectional area of opening portion 104 decreasing substantially linearly toward a zero effective area as piston 66 approaches the seating position (SP) where valve head 58 is seated against valve seat 60. Referring to FIG. 6, a graph of the damping force generated in chamber portion 92 during the last 1 mm of travel of damper stem 64 and valve member 28 is shown. As shown by curve 108, the damping force in chamber portion 92 is maintained at over 280 Newtons, for example, prior to valve seating. This damping force causes the velocity of piston 66, damper stem 64, and valve member 28, shown by curve 110 in FIG. 5, to smoothly approach 0 m/s during valve seating.

The inventive damper system provides a substantial advantage over known systems, such as the constant area orifice system described in U.S. Pat. No. 5,832,883. Referring FIG. 5, the curve 112 represents the response of the conventional constant area orifice, assuming a piston size of 20 mm, during the final 1 mm of travel prior to valve seating. As shown, the velocity of the conventional system is approximately 0.8 m/s just prior to valve seating—as compared to a seating velocity of 0.1 m/s of the inventive damping system 22. Thus, the inventive damper 22 substantially reduces the velocity of valve member 28 as compared to the conventional system.

Further, as shown in FIG. 6, the damping force in chamber portion 92 is maintained at approximately 280 N just prior to valve seating as compared to 180 N of damping force generated by the known system. Accordingly, the inventive system maintains a greater damping force prior to valve seating for a given piston diameter, as compared to the known systems. Thus, the piston size of the damper can be reduced as compared to known systems for a desired damping force—which reduces the reciprocating mass of the electromechanical valve and undesirable mid-travel drag and friction forces acting on the damper piston. Thus, overall power consumption of an electromechanical valve assembly is reduced.

What is claimed is:

1. A hydraulic damper for an electromechanical valve, the valve having a valve member, comprising:

a housing defining a chamber for holding fluid extending along an axis;

a damper stem disposed in said chamber configured to move along said axis, said damper stem configured to be directly coupled to the valve member; and a piston coupled concentrically around said damper stem dividing said chamber into a first chamber portion and a second chamber portion, said housing having a conduit extending between said first chamber portion and said second chamber portion, said conduit having a first non-circular opening communicating with said first chamber portion, wherein when said piston moves past at least a portion of said non-circular opening, the effective cross-sectional area of said non-circular opening decreases substantially linearly, restricting fluid flow from said first chamber to reduce a velocity of said piston.

2. The hydraulic damper of claim 1 wherein when said damper stem is moved in a first axial direction said piston displaces fluid from said first chamber portion through said conduit to said second chamber portion until said piston closes off said non-circular opening of said conduit.

3. The hydraulic damper of claim 1 wherein said first non-circular opening of said conduit includes a tapered portion.

4. The hydraulic damper of claim 1 wherein said conduit has a second non-cylindrical opening communicating with said second chamber portion.

5. The hydraulic damper of claim 1 wherein said housing is configured to be mounted to the electromechanical valve.

6. The hydraulic damper of claim 1 wherein said piston has no bypass orifices extending therethrough allowing fluid communication between said first chamber portion and said second chamber portion.

7. A hydraulic damper for an electromechanical valve, the valve having a valve member, comprising:

a housing defining a chamber for holding fluid extending along an axis;

a damper stem disposed in said chamber configured to move along said axis, said damper stem configured to be directly coupled to the valve member; and a piston coupled concentrically around said damper stem dividing said chamber into a first chamber portion and a second chamber portion, said housing having a conduit extending between said first chamber portion and said second chamber portion, said conduit having a first opening with a tapered portion communicating with said first chamber portion, wherein when said piston moves past said tapered portion of said first opening in a first direction, the effective cross-sectional area of said opening decreases, restricting fluid flow from said first chamber portion to reduce a velocity of said piston.

8. The hydraulic damper of claim 7 wherein the effective cross-sectional area of said first opening decreases substantially linearly when said piston moves past said tapered portion of said first opening.

9. The hydraulic damper of claim 7 wherein said piston has no bypass orifices extending therethrough allowing fluid communication between said first chamber portion and said second chamber portion.

* * * * *